US012774708B2

(12) United States Patent
Chen et al.

(10) Patent No.: US 12,774,708 B2
(45) Date of Patent: Oct. 27, 2026

(54) BUFFER ASSEMBLY

(71) Applicant: PEGATRON CORPORATION, Taipei City (TW)

(72) Inventors: Kuo-Chi Chen, Taipei City (TW); Wei-Pang Chi, Taipei City (TW)

(73) Assignee: PEGATRON CORPORATION, Taipei City (TW)

( * ) Notice: Subject to any disclaimer, the term of this patent is extended or adjusted under 35 U.S.C. 154(b) by 494 days.

(21) Appl. No.: 18/542,348

(22) Filed: Dec. 15, 2023

(65) Prior Publication Data

US 2024/0280116 A1 Aug. 22, 2024

(30) Foreign Application Priority Data

Feb. 18, 2023 (TW) ..... 112105967

(51) Int. Cl.
*F04D 29/64* (2006.01)
*F04D 19/00* (2006.01)
*F04D 29/66* (2006.01)

(52) U.S. Cl.
CPC ..... *F04D 29/644* (2013.01); *F04D 29/668* (2013.01); *F04D 19/002* (2013.01)

(58) Field of Classification Search
CPC .... F04D 29/668; F04D 29/644; F04D 29/601; F04D 29/646; F04D 25/166; F04D 25/0613; F04D 19/002; F16F 15/04; F16F 2230/34
USPC ..... 188/382
See application file for complete search history.

(56) References Cited

U.S. PATENT DOCUMENTS

2002/0139908 A1* 10/2002 Oyama ..... F16M 7/00 248/188.8
2006/0029492 A1* 2/2006 Kao ..... F04D 29/601 415/119
2006/0233638 A1* 10/2006 Chen ..... F04D 29/582 415/53.1
2010/0232933 A1* 9/2010 Chen ..... F04D 29/668 415/119

FOREIGN PATENT DOCUMENTS

| | | |
|---|---|---|
| CN | 2889000 | 4/2007 |
| CN | 205401377 | 7/2016 |
| TW | M569676 | 11/2018 |

* cited by examiner

*Primary Examiner* — David R Morris
*Assistant Examiner* — San M Aung
(74) *Attorney, Agent, or Firm* — J.C. PATENTS

(57) ABSTRACT

A buffer assembly includes a screw rod, a base, a rotating element and a clamping ring. The rotating element is rotatably disposed on the base along a rotation axis. The rotating element includes a through hole. The clamping ring is detachably connected to the rotating element along a connection axis, so that the clamping ring is adapted to switch to a connected state or an open state. The clamping ring includes a position-limiting space, and the rotation axis is perpendicular to the connection axis. When the clamping ring is in the connected state, the position-limiting space and the through hole are located on the rotation axis, and the screw rod pushes the clamping ring to rotate so that the screw rod passes through the position-limiting space and the through hole. When the clamping ring is in the open state, the position-limiting space is misaligned with the rotation axis.

10 Claims, 10 Drawing Sheets

BUFFER ASSEMBLY

CROSS-REFERENCE TO RELATED APPLICATION

This application claims the priority benefit of Taiwan application serial no. 112105967, filed on Feb. 18, 2023. The entirety of the above-mentioned patent application is hereby incorporated by reference herein and made a part of this specification.

BACKGROUND

Technical Field

The present disclosure relates to an assembly, and in particular to a buffer assembly.

Description of Related Art

In existing technologies, chassis and components will be equipped with a buffer assembly during assembly for buffering. The buffer assembly is, for example, a damping gear. It is required to add damping oil to the damping gear to increase friction and achieve a buffering effect. However, the damping properties of the damping oil will change with some factors such as temperature and humidity, causing the buffering effect of the damping gear to attenuate or disappear. When the components are removed from the chassis, the components will interfere with the damping gear and cannot be removed quickly.

SUMMARY

The present disclosure provides a buffer assembly, which has a buffering function during assembly and may be quickly disassembled.

The buffer assembly of the disclosure includes a screw rod, a base, a rotating element and a clamping ring. The rotating element is rotatably disposed at the base along a rotation axis. The rotating element includes a through hole. The clamping ring is detachably connected to the rotating element along a connection axis, so that the clamping ring is adapted to switch to a connected state or an open state. The clamping ring includes a position-limiting space, and the rotation axis is perpendicular to the connection axis. When the clamping ring is in the connected state, the position-limiting space and the through hole are located on the rotation axis, and the screw rod pushes the clamping ring to rotate so that the screw rod passes through the position-limiting space and the through hole. When the clamping ring is in the open state, the position-limiting space is misaligned with the rotation axis, and the screw rod passes through the through hole.

In an embodiment of the present disclosure, the clamping ring includes a clamping ring body and two position-limiting protrusions. The two position-limiting protrusions protrude toward the connection axis from the clamping ring body. The position-limiting space is located in the center of the clamping ring body.

In an embodiment of the present disclosure, the position-limiting space gradually expands from a position relative to the two position-limiting protrusions toward both ends along the connection axis.

In an embodiment of the present disclosure, the rotating element includes an engaging protrusion, and a width of the engaging protrusion perpendicular to the connection axis is greater than a center distance of the position-limiting space perpendicular to the connection axis.

In an embodiment of the present disclosure, the outer diameter of the screw rod is greater than the center distance of the position-limiting space perpendicular to the connection axis, and the outer diameter is less than the diameter of the through hole of the rotating element. When the clamping ring is in a connected state, the clamping ring is adaptable for being pushed by the screw rod to rotate, and the clamping ring drives the rotating element to rotate.

In an embodiment of the present disclosure, the rotating element includes a first portion, an engaging protrusion and a second portion. The engaging protrusion is connected between the first portion and the second portion, and the clamping ring is located between the first portion and the second portion. The clamping ring is adapted to engage with the engaging protrusion so that the position-limiting space is misaligned with the rotation axis.

In an embodiment of the present disclosure, the screw rod includes a flatness portion and a spiral portion. The flatness portion is connected to the spiral portion. The flatness portion and the spiral portion extend along the rotation axis. When the flatness portion passes through the position-limiting space, the flatness portion is at least partially located on the connection axis.

In an embodiment of the present disclosure, the clamping ring further includes a clamping ring body and an operating portion connected to the clamping ring body. The operating portion extends along the rotation axis. The second portion of the rotating element includes an inclined surface. The inclined surface faces the operating portion.

In an embodiment of the present disclosure, the base includes an accommodation space, the clamping ring and the rotating element are movably arranged in the accommodation space. When the clamping ring is in an open state, the clamping ring at least partially leaves the accommodation space.

In an embodiment of the present disclosure, the rotation axis is parallel to a gravity direction.

Based on the above, by using the rotating element and the clamping ring of the buffer assembly disclosed in the present disclosure to cooperate with the screw rod, it is possible to achieve the buffering function during assembly. Also, because the clamping ring is able to move relative to the rotating element and switch to the connected state or the open state, when the clamping ring is in the open state, the screw rod is misaligned with the position-limiting space, and the screw rod passes through the rotating element without contacting the clamping ring. Therefore, it is possible to achieve the purpose of rapid disassembly.

In order to make the above-mentioned features and advantages of the present disclosure more obvious and understandable, embodiments are given below and described in detail with reference to the attached drawings.

DESCRIPTION OF THE EMBODIMENTS

Figure 1:
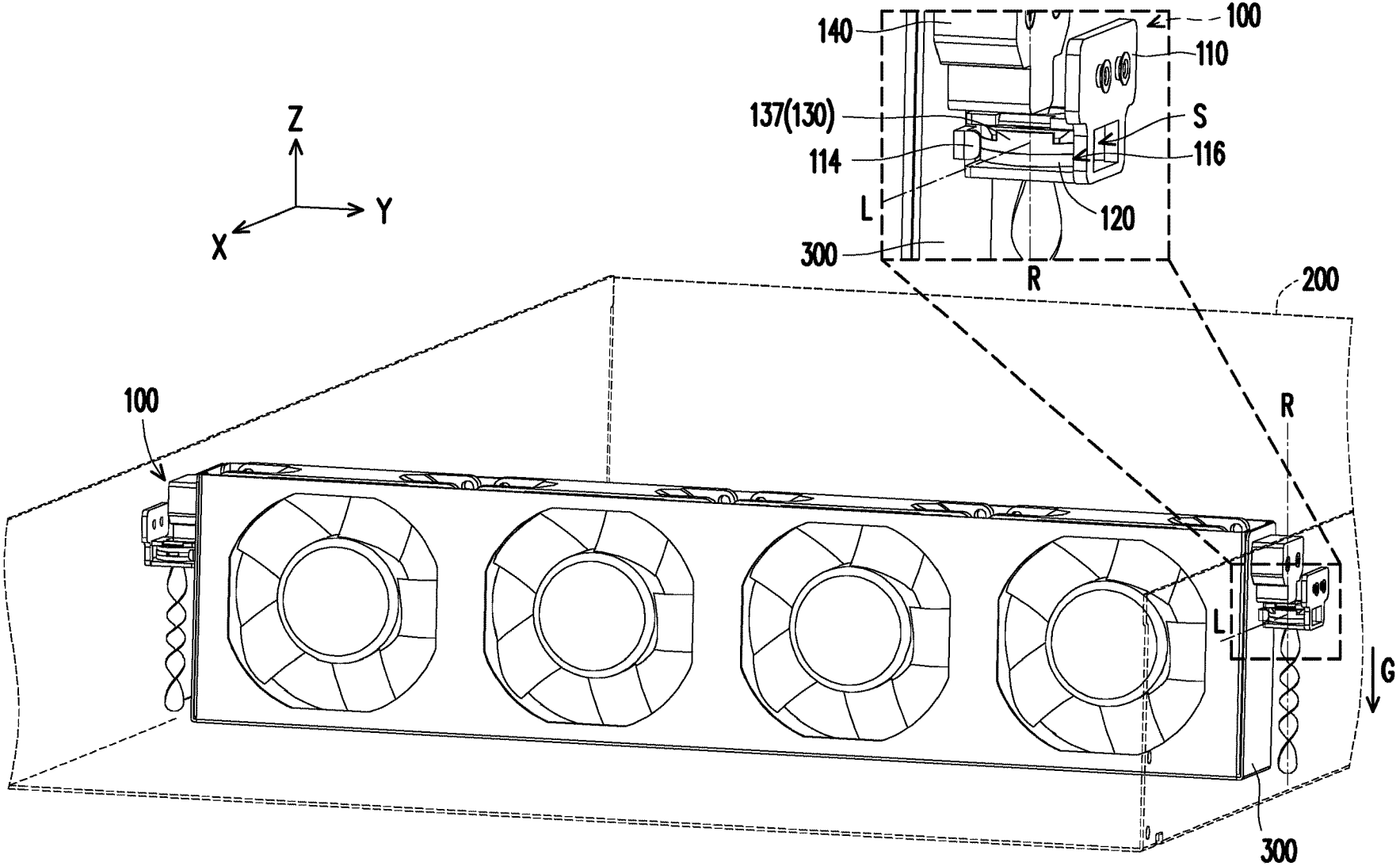
FIG. 1 is a schematic view of a buffer assembly according to an embodiment of the present disclosure.
Figure 2:
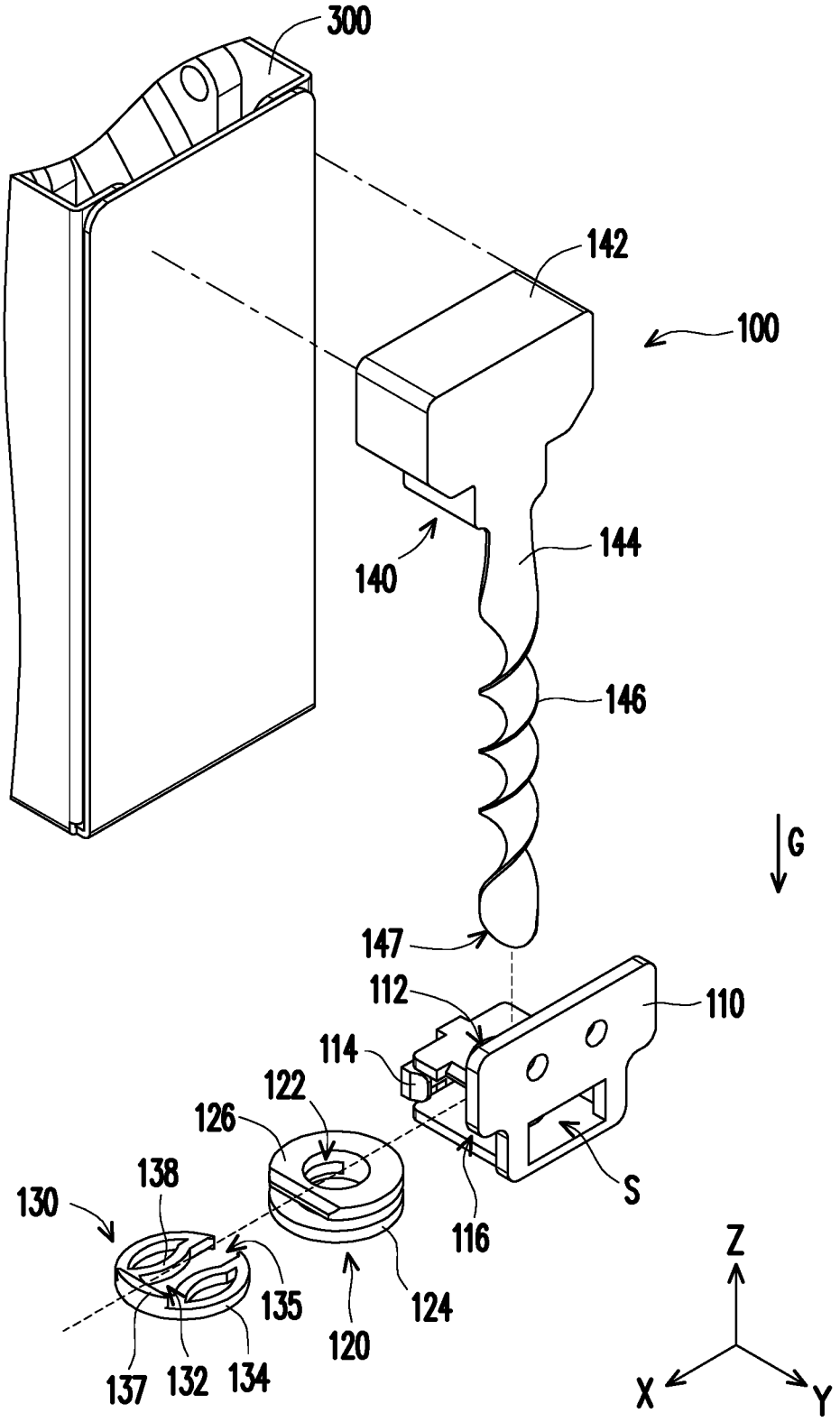
FIG. 2 is an exploded view of the buffer assembly and casing of FIG. 1.
Figure 3:
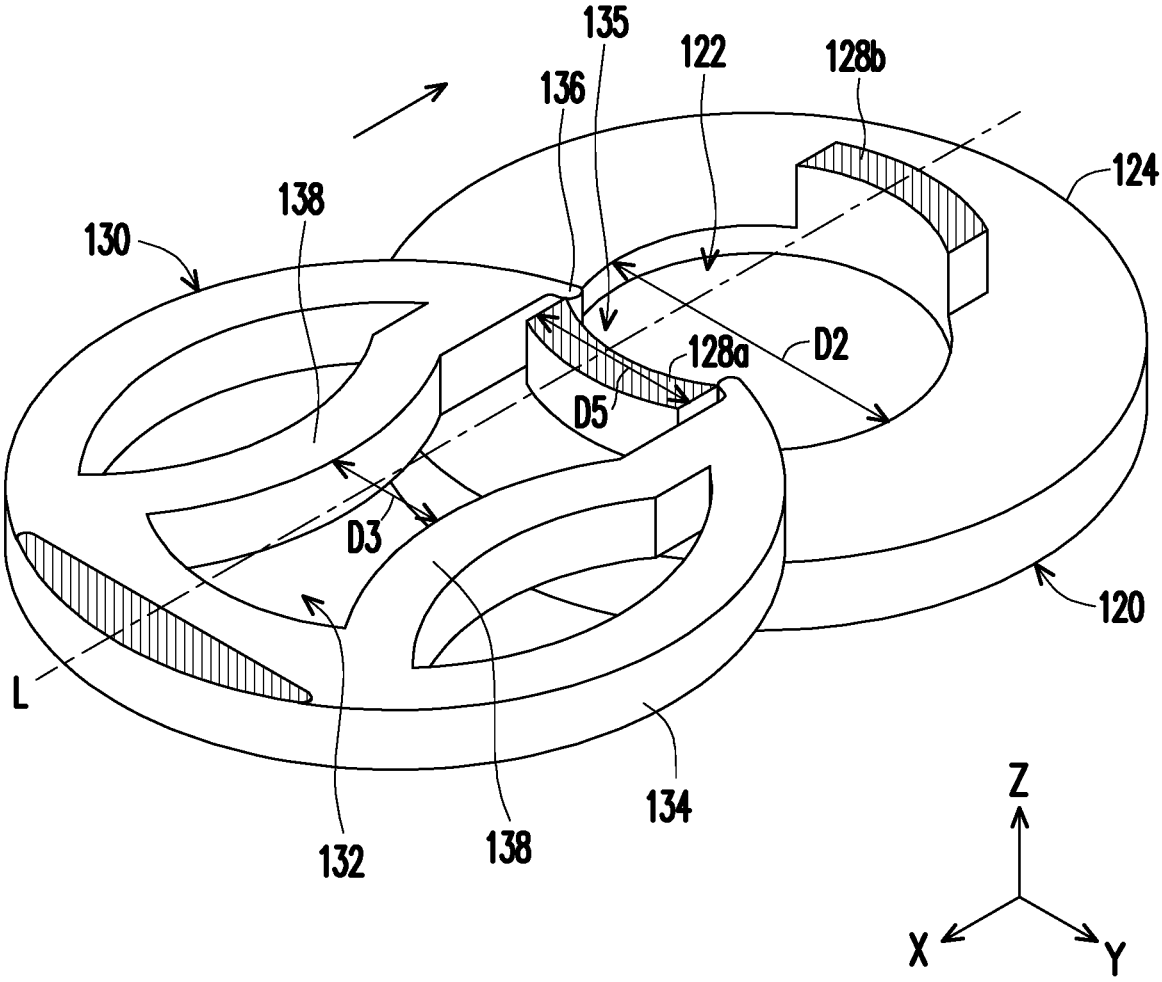
FIG. 3 and FIG. 4A are cross-sectional views of the connection process of the clamping ring and the rotating element of FIG. 1.
Figure 4A:
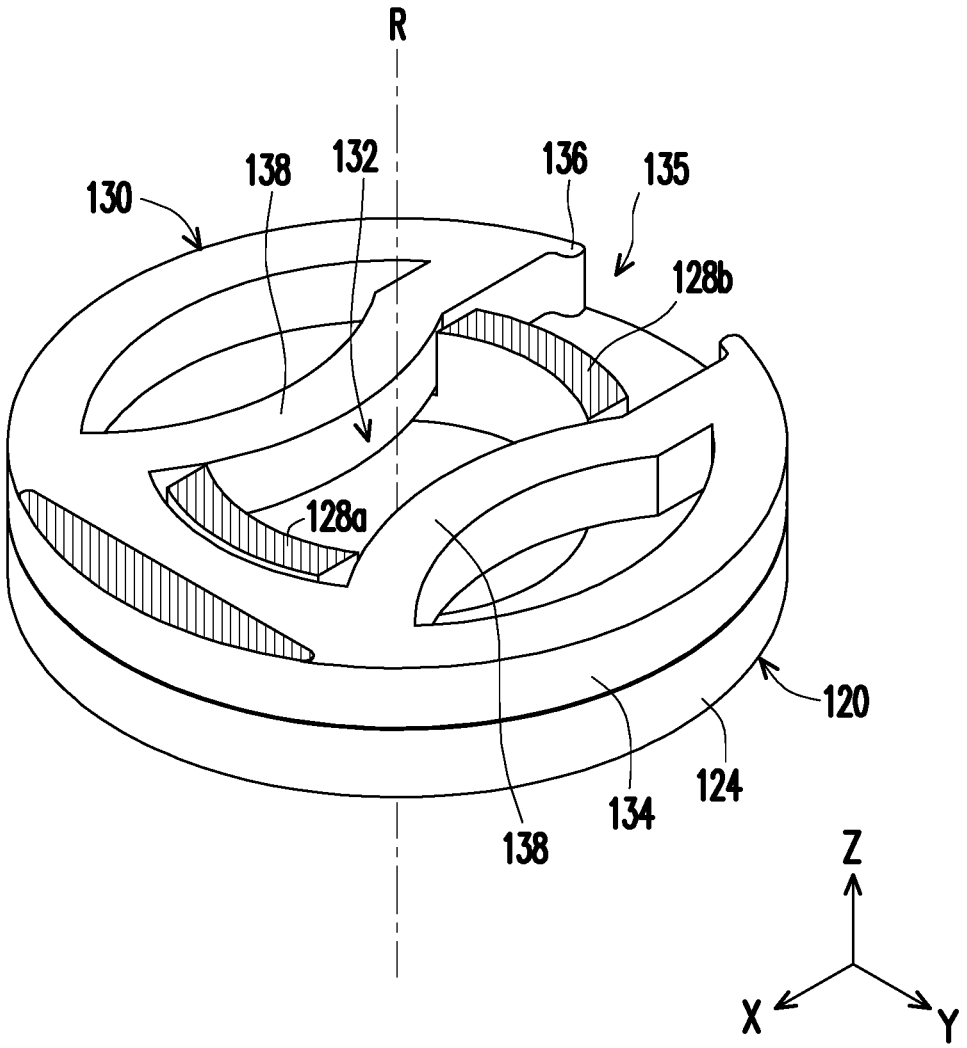
Figure 4B:
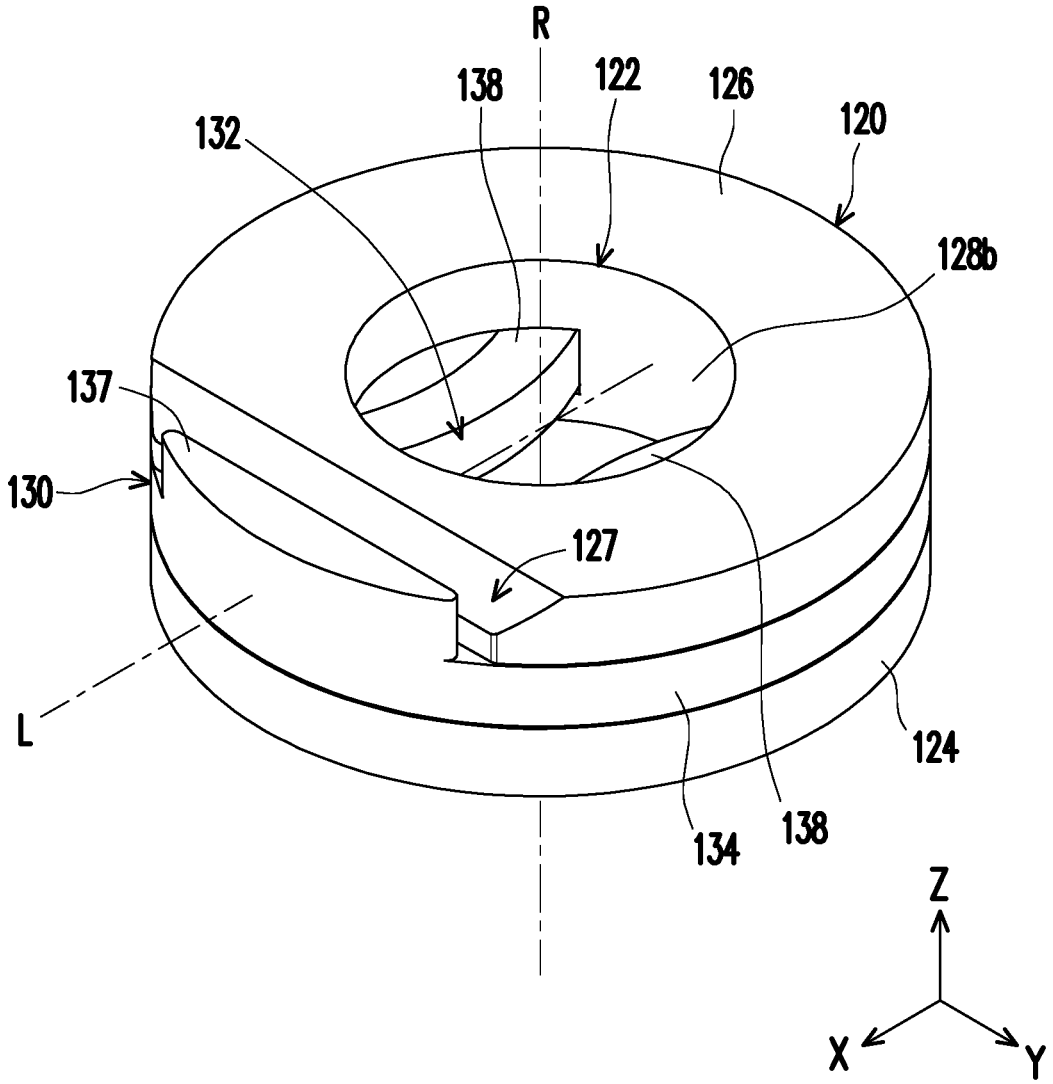
FIG. 4B is a schematic view after the clamping ring and the rotating element are connected.

FIG. 1 is a schematic view of a buffer assembly according to an embodiment of the present disclosure. FIG. 2 is an exploded view of the buffer assembly and casing of FIG. 1. FIG. 3 and FIG. 4A are cross-sectional views of the connection process of the clamping ring and the rotating element of FIG. 1. FIG. 4B is a schematic view after the clamping ring and the rotating element are connected. Cartesian coordinates X-Y-Z are incorporated in the specification to facilitate comprehension of description of components.

Please refer to FIG. 1 to FIG. 4B. FIG. 1 shows a chassis 200, a casing 300 disposed in the chassis 200 and a buffer assembly 100. The buffer assembly 100 includes a base 110, a rotating element 120, a clamping ring 130 and a screw rod 140. The base 110 is fixed at the chassis 200, and the screw rod 140 is fixed at a lateral side of the casing 300. The base 110 and the screw rod 140 are fixed at the chassis 200 and the casing 300 by screws, respectively, for example, but are not limited thereto. The casing 300 of this embodiment is, for example, a casing of a fan assembly, and a buffer assembly 100 is disposed on both sides of the chassis 200 and the casing 300 respectively, but is not limited thereto.

The base 110 includes an accommodation space S. The rotating element 120 is rotatably disposed in the accommodation space S of the base 110 along a rotation axis R. The rotating element 120 includes a through hole 122, and the central axis of the through hole 122 is the rotation axis R. The clamping ring 130 is detachably connected to the rotating element 120 along a connection axis L. The clamping ring 130 includes a clamping ring body 134, and the connection axis L is perpendicular to the central axis of the clamping ring body 134 and perpendicular to the rotation axis R. When the rotating element 120 is connected to the clamping ring 130, the central axis of the through hole 122 may coincide with the central axis of the clamping ring body 134. The clamping ring 130 may rotate together with the rotating element 120. The rotation axis R in this embodiment is parallel to the Z-axis and a gravity direction G, but is not limited thereto. The screw rod 140 may pass through the rotating element 120, the clamping ring 130 and the base 110 along the rotation axis R.

As shown in FIG. 2 and FIG. 3, the clamping ring 130 includes a position-limiting space 132, two fasteners 136 and two position-limiting protrusions 138. The clamping ring body 134 has an opening 135, and the shape of the clamping ring body 134 is, for example, a C-shape. The position-limiting space 132 is located in the center of the clamping ring body 134 and connected with the opening 135, and both the position-limiting space 132 and the opening 135 are located on the connection axis L. That is, the connection axis L is an extended axis connecting the center of the opening 135 and the center of the position-limiting space 132. Two position-limiting protrusions 138 respectively protrude toward the connection axis L (i.e., the center of the clamping ring body 134) from both sides of the clamping ring body 134. Each of the position-limiting protrusions 138 is, for example, an arc shape. The position-limiting space 132 gradually expands from a position relative to the two position-limiting protrusions 138 to both ends along the connection axis L. Each of the two fasteners 136 protrudes toward the connection axis L from the clamping ring body 134 and extends into the opening 135. Specifically, the two fasteners 136 are located at two free ends of the C-shaped clamping ring body 134, respectively, and the two free ends correspond to the opening 135.

The rotating element 120 includes a first portion 124, engaging protrusions 128*a* and 128*b* and a second portion 126. The second portion 126 is located above the first portion 124 in the gravity direction G. The rotating element 120 in this embodiment has a double-layer structure, but is not limited thereto. The through hole 122 passes through the first portion 124 and the second portion 126. The number of the engaging protrusions 128*a* and 128*b* is two, but is not limited thereto. The engaging protrusions 128*a* and 128*b* are connected between the first portion 124 and the second portion 126.

As shown in FIG. 3 and FIG. 4A, the clamping ring 130 is adapted to move toward the rotating element 120 along the connection axis L to connect with the rotating element 120. The width of the opening 135 of the clamping ring body 134 perpendicular to the connection axis L is less than the width D5 of the engaging protrusion 128*a* perpendicular to the connection axis L.

When the clamping ring 130 and the rotating element 120 are to be assembled, the fasteners 136 of the clamping ring 130 may abut against the engaging protrusion 128*a*. Under the circumstances, the engaging protrusions 128*a* and 128*b* are located on the connection axis L. The clamping ring 130 may receive a pushing force to make the engaging protrusion 128*a* to open the fasteners 136. Then the clamping ring 130 is slightly deformed, and the width of the deformed opening 135 is greater than the width D5 of the engaging protrusion 128*a*, so that the clamping ring 130 may move to the position shown in FIG. 3.

As the clamping ring 130 continues to receive the pushing force, the fasteners 136 move away from the engaging protrusion 128*a*, causing the engaging protrusion 128*a* to enter the position-limiting space 132. The engaging protrusion 128*a* may push against the two position-limiting protrusions 138 to open the clamping ring 130. The clamping ring 130 is slightly deformed and continues to move along the connection axis L until the engaging protrusion 128*a* is located at one end away from the fasteners 136 (FIG. 4A).

As shown in FIG. 3, the width D5 of the engaging protrusion 128*a* is greater than the center distance D3 of the position-limiting space 132 perpendicular to the connection axis L (Y-axis direction), so the engaging protrusion 128*a* is not able to move out of the clamping ring 130 without being applied with a force, and therefore the clamping ring 130 and the rotating element 120 may be firmly connected. Under the circumstances, the clamping ring 130 and the rotating element 120 are completely assembled. As shown in FIG. 4B, the clamping ring 130 is located between the first portion 124 and the second portion 126. When the clamping ring 130 rotates, the clamping ring 130 may drive the rotating element 120 to rotate together.

As shown in FIG. 4B, the clamping ring 130 further includes an operating portion 137. The operating portion 137 is connected to the clamping ring body 134 and extends along the rotation axis R. The operating portion 137 and the fasteners 136 (see FIG. 4A) are located at opposite ends of the clamping ring body 134. The second portion 126 of the rotating element 120 includes an inclined surface 127 facing the operating portion 137. When the clamping ring 130 is to be disposed on or removed from the rotating element 120, the operating portion 137 may be pulled by the user to manipulate the clamping ring 130 to move. The inclined surface 127 is disposed to help the user to pull the operating portion 137 with fingers.

The structures of the clamping ring 130 and the rotating element 120 are not limited to this embodiment. For example, in other embodiments, the rotating element 120 may include only the first portion 124 and the engaging protrusions 128*a* and 128*b*, resulting in the rotating element 120 being a single-layer structure. The position-limiting protrusions 138 of the clamping ring 130 may also be triangular in addition to the arc shape.

After the clamping ring 130 and the rotating element 120 are completely connected, the clamping ring 130 and the rotating element 120 may be placed on the base 110. As shown in FIG. 2, the base 110 includes a mounting hole 116, and the mounting hole 116 is connected to the accommodation space S.

When the clamping ring 130 and the rotating element 120 are to be assembled into the base 110, the clamping ring 130 and the rotating element 120 may pass through the mounting holes 116 of the base 110 and move into the accommodation space S. The base 110 further includes a hook 114. The hook 114 is located on one side of the mounting hole 116. The rotating element 120 may abut against and push away the hook 114 to enter the base 110. After the clamping ring 130, the rotating element 120 and the base 110 are completely assembled, the hook 114 is reset to prevent the clamping ring 130 and the rotating element 120 from moving out of the base 110 without being applied with a force. At this point, the clamping ring 130, the rotating element 120 and base 110 are completely assembled.

The assembly method of the clamping ring 130, the rotating element 120 and the base 110 is not limited thereto. In other embodiments, the rotating element 120 may be placed into the base 110 first, and then the clamping ring 130 is connected to the rotating element 120.

Figure 5:
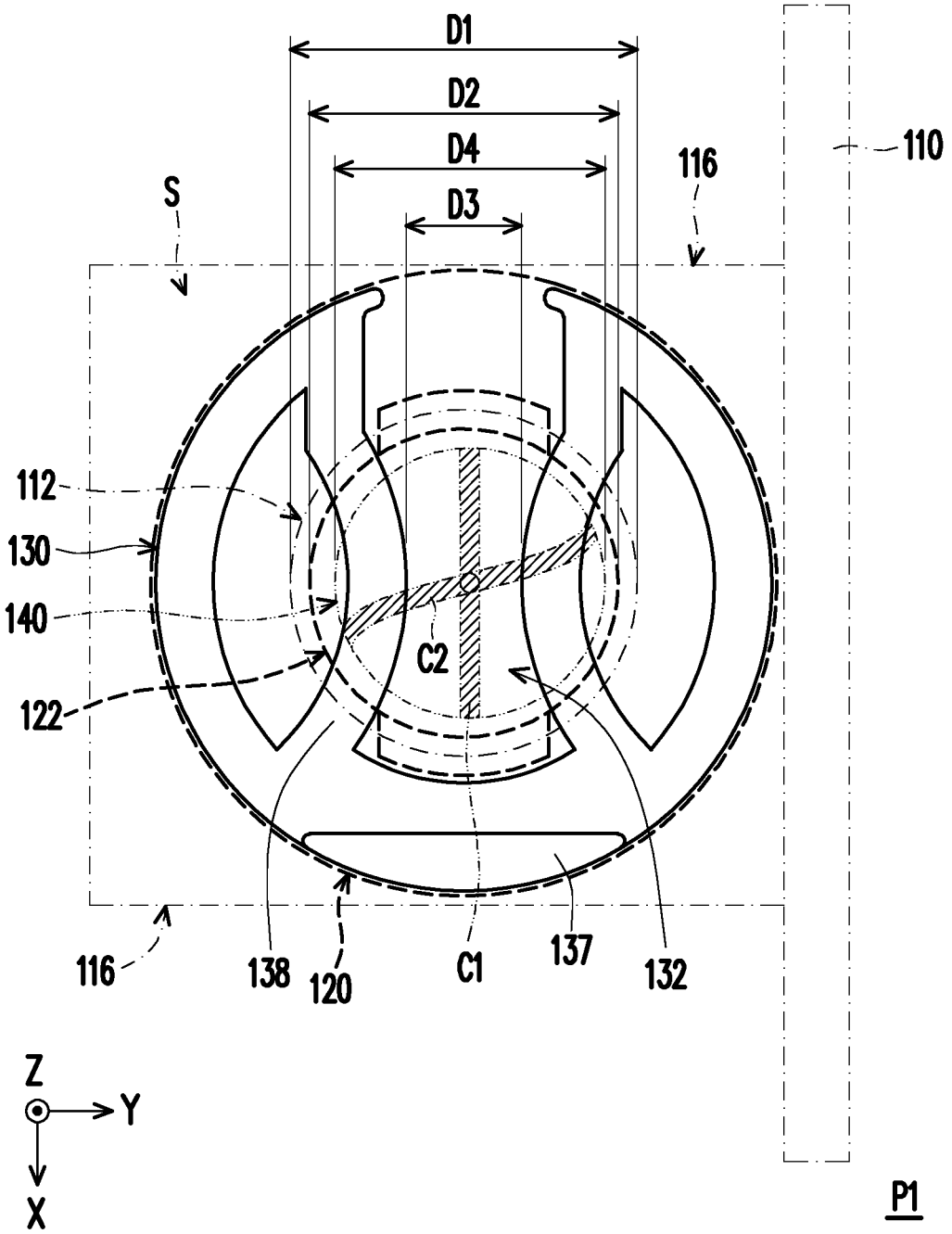
FIG. 5 is a schematic view of the clamping ring of FIG. 1 in a connected state.
Figure 6:
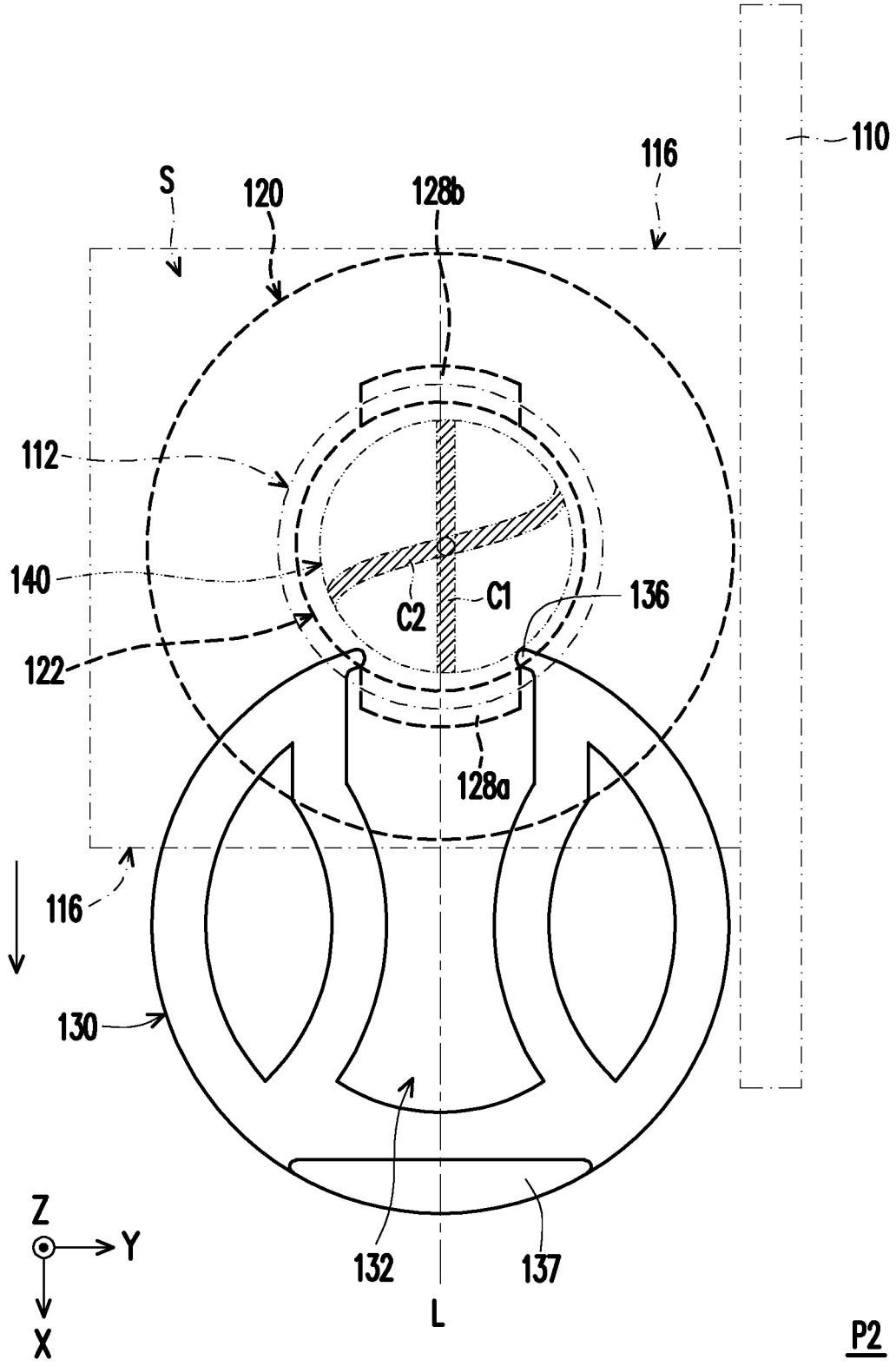
FIG. 6 is a schematic view of the clamping ring of FIG. 1 in an open state.

FIG. 5 is a schematic view of the clamping ring of FIG. 1 in a connected state. FIG. 6 is a schematic view of the clamping ring of FIG. 1 in an open state. The screw rod 140, the base 110 and the rotating element 120 in FIG. 5 and FIG. 6 are shown in a perspective view and some structures are omitted. Please refer to FIG. 2, FIG. 5 and FIG. 6. The screw rod 140 includes a head 142, a flatness portion 144 and a spiral portion 146. The flatness portion 144 is connected between the spiral portion 146 and the head 142, and the head 142 is locked to the casing 300. The flatness portion 144 and the spiral portion 146 extend along the rotation axis R. The clamping ring 130 may move relative to the base 110 and the rotating element 120, and the clamping ring 130 may be switched to a connected state P1 or an open state P2.

FIG. 5 and FIG. 6 schematically illustrate a cross-section C1 of the flatness portion 144 along the direction perpendicular to the rotation axis R, and a cross-section C2 of the terminal end 147 of the spiral portion 146 along the direction perpendicular to the rotation axis R. As shown in FIG. 5 and FIG. 6, the base 110 includes an opening 112. The diameter D1 of the opening 112 is larger than the diameter D2 of the through hole 122 of the rotating element 120. The diameter D2 of the through hole 122 is larger than the center distance D3 of the position-limiting space 132. The outer diameter D4 of the spiral portion 146 is larger than the center distance D3 and smaller than the diameter D2 of the through hole 122.

As shown in FIG. 4B and FIG. 5, when the clamping ring 130 is in the connected state P1, the clamping ring 130 is completely pushed into the rotating element 120, and the engaging protrusions 128*a* and 128*b* of the rotating element 120 are located in the position-limiting space 132 of the clamping ring 130. The position-limiting space 132 and the through hole 122 are located on the rotation axis R. The cross-section C2 of the spiral portion 146 partially overlaps the position-limiting protrusions 138 and may be structurally interfered with the clamping ring 130. Specifically, the spiral portion 146 may push against the clamping ring 130 (position-limiting protrusion 138), thereby causing the clamping ring 130 and the rotating element 120 to rotate.

As shown in FIG. 3 and FIG. 6, when the clamping ring 130 moves away from the base 110 along the connection axis L, and the clamping ring 130 is in the open state P2, the fasteners 136 may engage with the engaging protrusion 128*a*, and the position-limiting space 132 is misaligned with the through hole 122 and the rotation axis R. The clamping ring 130 is at least partially separated from the accommodation space S of the base 110, and the screw rod 140 may pass through the rotating element 120 and the base 110 without being structurally interfered with the clamping ring 130.

Since the fasteners 136 of the clamping ring 130 are engaged with the engaging protrusion 128*a*, the clamping ring 130 may still be connected to the rotating element 120 when no external force is applied, so as to prevent the user from losing the clamping ring 130 and causing failure of the buffer assembly 100. In other embodiments, the clamping ring 130 may be completely moved away from the rotating element 120, so that the clamping ring 130 is completely separated from the accommodation space S.

Figure 7:
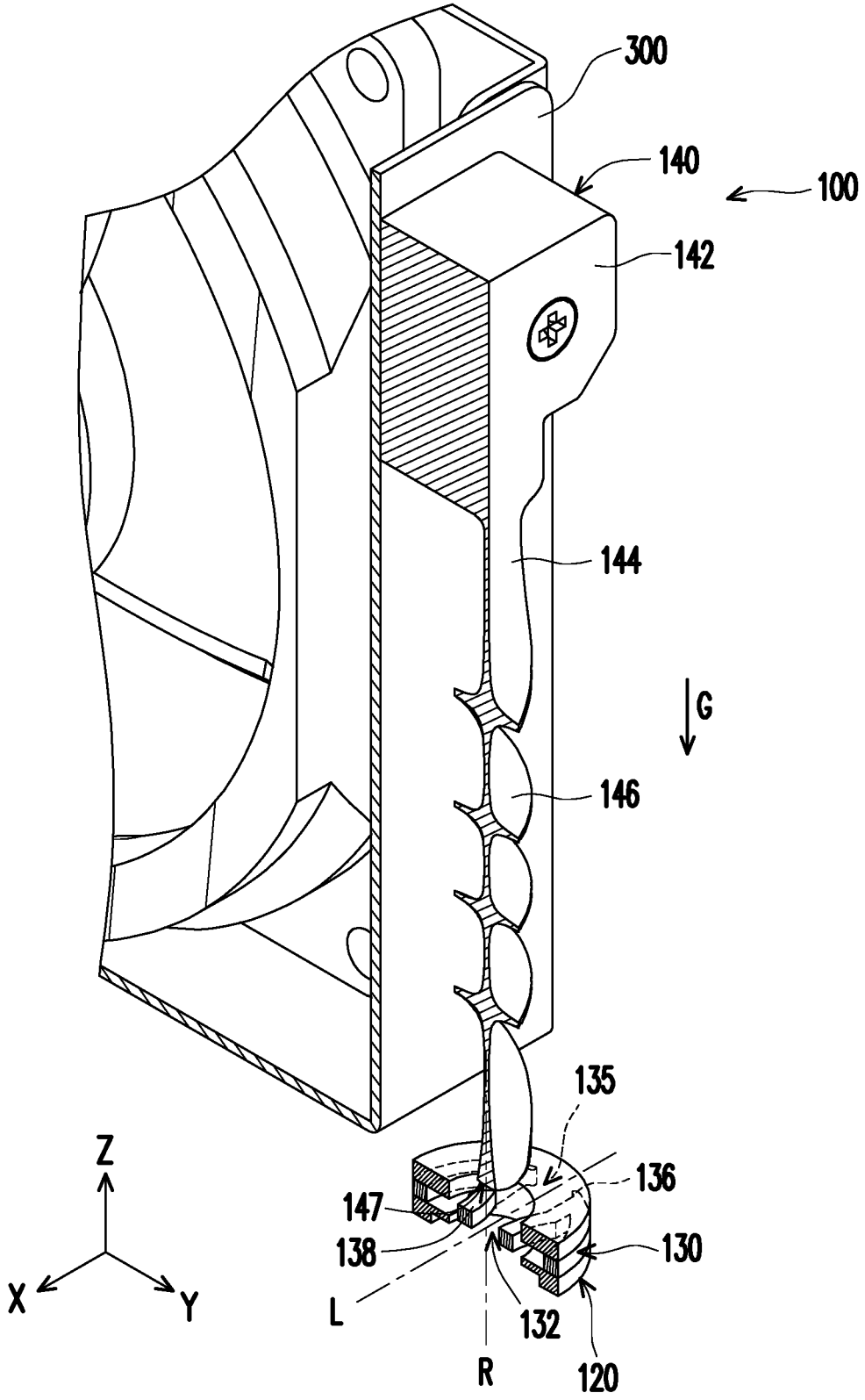
FIG. 7 to FIG. 9 are cross-sectional views of the moving process of the screw rod of the buffer assembly in FIG. 1.
Figure 8:
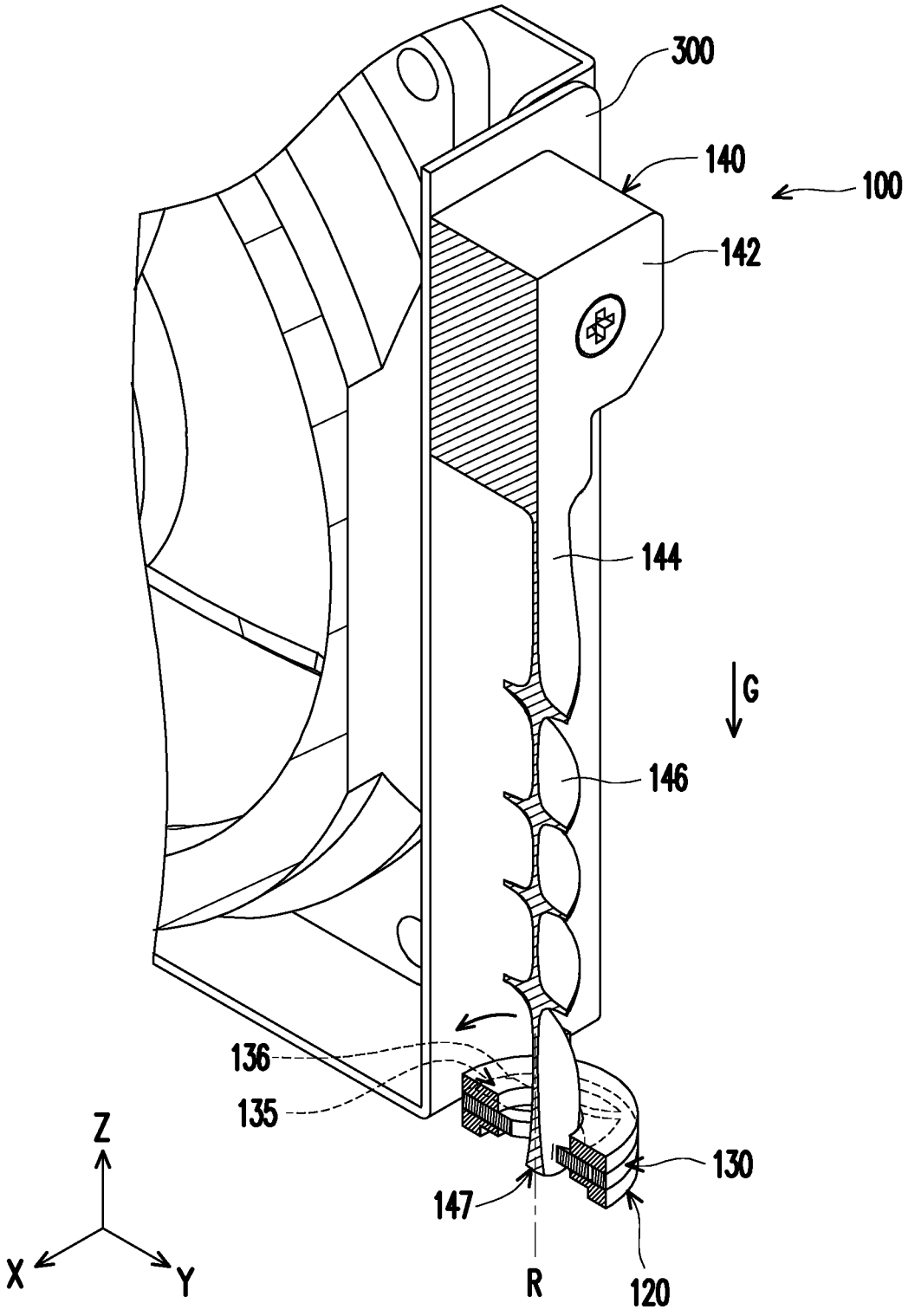
Figure 9:
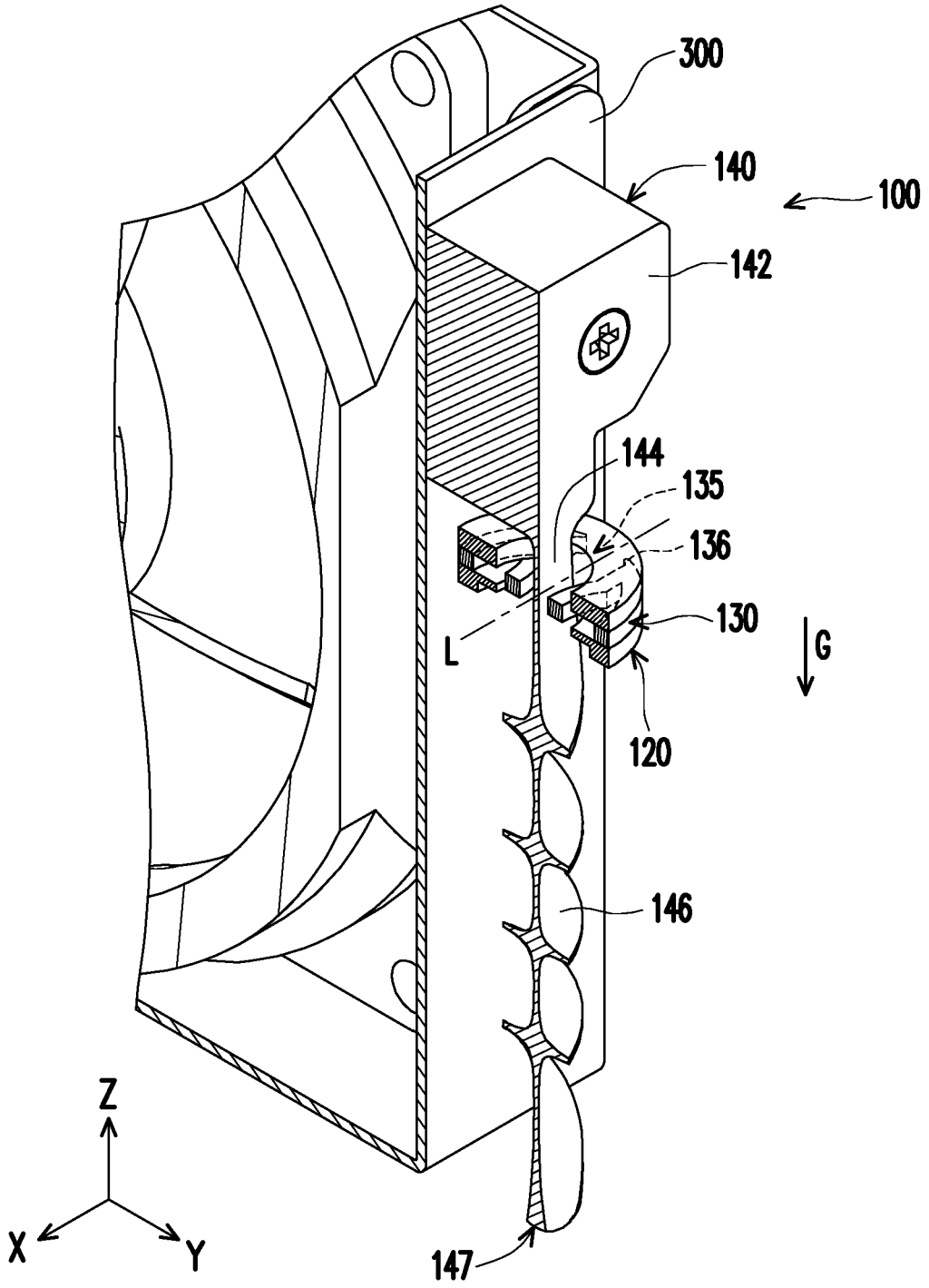

FIG. 7 to FIG. 9 are cross-sectional views of the moving process of the screw rod of the buffer assembly in FIG. 1. The base 110 is omitted and part of the structure of the clamping ring 130 is schematically shown with dashed lines. Please refer to FIG. 7 to FIG. 9. When the casing 300 is to be assembled into the chassis 200, the screw rod 140 fixed on the casing 300 is aligned with the clamping ring 130 and the rotating element 120 along the rotation axis R. Since the rotation axis R is parallel to the gravity direction G, the casing 300 and screw rod 140 may fall freely along the gravity direction G.

As shown in FIG. 7, the terminal end 147 of the spiral portion 146 of the screw rod 140 passes through the through hole 122 of the rotating element 120 until the terminal end 147 abuts against the position-limiting protrusions 138.

The screw rod 140 continues to move downward from the position shown in FIG. 7, and the terminal end 147 of the screw rod 140 pushes against the two position-limiting protrusions 138, causing the clamping ring 130 to rotate relative to the screw rod 140. The rotation of the clamping ring 130 drives the rotating element 120 to rotate. The clamping ring 130 and the rotating element 120 continue to rotate until the terminal end 147 is misaligned with the position-limiting protrusions 138, and the terminal end 147 no longer pushes against the position-limiting protrusions 138 and enters the position-limiting space 132. Under the circumstances, the screw rod 140 moves from the position shown in FIG. 7 to the position shown in FIG. 8. The screw rod 140 passes through the position-limiting space 132 and the through hole 122.

Then, the screw rod 140 continues to move downward, and the spiral portion 146 continues to push against the position-limiting protrusions 138 of the clamping ring 130, causing the clamping ring 130 and the rotating element 120 to rotate until the casing 300 and the screw rod 140 move relative to the clamping ring 130 and the rotating element 120 to the position shown in FIG. 9 from the position shown in FIG. 8. As shown in FIG. 9, the flatness portion 144 of the screw rod 140 passes through the clamping ring 130 and the rotating element 120, and the base 110 abuts against the head 142 of the screw rod 140 (see the enlarged view of FIG. 1). At this point, the casing 300 and the chassis 200 are completely assembled.

As shown in FIG. 5, the cross section C1 of the flatness portion 144 extends in the X-axis direction. When the flatness portion 144 passes through the clamping ring 130 and the rotating element 120, the flatness portion 144 is at least partially located on the connection axis L. The flatness portion 144 may limit the rotation of the clamping ring 130 and the rotating element 120, and the flatness portion 144 will not abut against the position-limiting protrusions 138.

During the assembly process of the casing 300 and the chassis 200, since the screw rod 140 needs to push the clamping ring 130 in order to move downward, the moving speed of the screw rod 140 (casing 300) may be reduced to achieve a buffering effect. In addition, since the rotation axis R is parallel to the gravity direction G, the screw rod 140 is aligned with the base 110, the clamping ring 130 and the rotating element 120, so that the screw rod 140 is able to fall freely through its own gravity without being applied with an external force, thereby enhancing the convenience of use of the buffer assembly 100. The clamping ring 130 in this embodiment may be made of plastic to ensure that the clamping ring 130 will not generate debris due to collision during contact or rotation with the screw rod 140, but is not limited thereto.

When the casing 300 is to be disassembled from the chassis 200, the clamping ring 130 may move away from the rotating element 120, so that the clamping ring 130 is in the open state P2. As shown in FIG. 5 and FIG. 9, since the cross-section C1 of the flatness portion 144 extends along the X-axis direction, and the mounting hole 116 is also located on the X-axis, when the flatness portion 144 passes through the position-limiting space 132, the operating portion 137 of the clamping ring 130 corresponds to mounting hole 116 of the base 110. The operating portion 137 may be pulled to move the clamping ring 130, and the clamping ring 130 at least partially passes through the mounting hole 116 and is in an open state P2 as shown in FIG. 6.

The position-limiting space 132 of the clamping ring 130 in the open state P2 is misaligned with the screw rod 140 and the rotation axis R. Since there will be no structural interference between the position-limiting space 132 and the screw rod 140, and the outer diameter D4 of the screw rod 140 (see FIG. 6) is smaller than the diameter D2 of the through hole 122, the screw rod 140 may move away from the base 110 and the rotating element 120 without hindrance. In this way, the user may quickly detach the casing 300 from the chassis 200.

It can be seen that when the screw rod 140 is assembled with the base 110, the rotating element 120 and the clamping ring 130, the clamping ring 130 may be in the connected state P1 so that the buffer assembly 100 has a buffering function. When the screw rod 140 is to be moved away from the base 110, the rotating element 120 and the clamping ring 130, the clamping ring 130 may be in the open state P2 so that the buffer assembly 100 does not have the buffering function. The screw rod 140 may quickly be removed from the base 110, the rotating element 120 and the clamping ring 130 to improve the efficiency of disassembling the buffer assembly 100.

In summary, the rotating element and clamping ring of the buffer assembly of the present disclosure cooperate with the screw rod to achieve the buffering function during assembly. Also, because the clamping ring may move relative to the rotating element and switch to the connected state or the open state, when the clamping ring is in the open state, the screw rod is misaligned with the position-limiting space, and the screw rod only passes through the rotating element without contacting the clamping ring, so it is possible to achieve the purpose of rapid dismantling.

Although the present disclosure has been disclosed as above in the form of embodiments, it is not intended to limit the disclosure. Anyone with ordinary knowledge in the technical field can make some modifications and refinement without departing from the spirit and scope of the disclosure, so the scope to be protected by this disclosure shall be defined by the scope of the appended claims.

What is claimed is:

1. A buffer assembly comprising:

a screw rod;

a base;

a rotating element rotatably disposed at the base along a rotation axis, wherein the rotating element comprises a through hole; and a clamping ring detachably connected to the rotating element along a connection axis, so that the clamping ring is adapted to switch to a connected state or an open state, wherein the clamping ring comprises a position-limiting space, and the rotation axis is perpendicular to the connection axis, when the clamping ring is in the connected state, the position-limiting space and the through hole are located on the rotation axis, and the screw rod is adapted to push the clamping ring to rotate so that the screw rod passes through the position-limiting space and the through hole, when the clamping ring is in the open state, the position-limiting space is misaligned with the rotation axis, and the screw rod passes through the through hole.

2. The buffer assembly according to claim 1, wherein the clamping ring comprises a clamping ring body and two position-limiting protrusions, the two position-limiting protrusions protrude toward the connection axis from the clamping ring body, and the position-limiting space is located in a center of the clamping ring body.

3. The buffer assembly according to claim 2, wherein the position-limiting space gradually expands from a position relative to the two position-limiting protrusions toward both ends along the connection axis.

4. The buffer assembly according to claim 1, wherein the rotating element comprises an engaging protrusion, and a width of the engaging protrusion perpendicular to the connection axis is greater than a center distance of the position-limiting space perpendicular to the connection axis.

5. The buffer assembly according to claim 1, wherein an outer diameter of the screw rod is greater than a center distance of the position-limiting space perpendicular to the connection axis, and the outer diameter is less than a diameter of the through hole of the rotating element, when the clamping ring is in the connected state, the clamping ring is adaptable for being pushed by the screw rod to rotate, and the clamping ring drives the rotating element to rotate.

6. The buffer assembly according to claim 1, wherein the rotating element comprises a first portion, an engaging protrusion and a second portion, the engaging protrusion is connected between the first portion and the second portion, and the clamping ring is located between the first portion and the second portion, the clamping ring is adapted to engage with the engaging protrusion so that the position-limiting space is misaligned with the rotation axis.

7. The buffer assembly according to claim 6, wherein the screw rod comprises a flatness portion and a spiral portion, the flatness portion is connected to the spiral portion, the flatness portion and the spiral portion extend along the rotation axis, when the flatness portion passes through the position-limiting space, the flatness portion is at least partially located on the connection axis.

8. The buffer assembly according to claim 6, wherein the clamping ring further comprises a clamping ring body and an operating portion connected to the clamping ring body, the operating portion extends along the rotation axis, the second portion of the rotating element comprises an inclined surface, and the inclined surface faces the operating portion.

9. The buffer assembly according to claim 1, wherein the base comprises an accommodation space, the clamping ring and the rotating element are movably disposed in the accommodation space, when the clamping ring is in the open state, the clamping ring at least partially leaves the accommodation space.

10. The buffer assembly according to claim 1, wherein the rotation axis is parallel to a gravity direction.

* * * * *